US009770695B2

(12) United States Patent
Kashiwagi et al.

(10) Patent No.: US 9,770,695 B2
(45) Date of Patent: Sep. 26, 2017

(54) EMULSION PREPARATION DEVICE AND EMULSION PREPARATION METHOD

(71) Applicant: Shionogi & Co., Ltd., Osaka (JP)

(72) Inventors: Hideji Kashiwagi, Osaka (JP); Yasushi Moroto, Osaka (JP); Kazuyuki Takata, Osaka (JP); Shuichi Hatano, Osaka (JP); Koji Karasawa, Tochigi (JP); Atsushi Ito, Tochigi (JP); Kazuhiro Ozawa, Osaka (JP)

(73) Assignee: Shionogi & Co., Ltd., Osaka (JP)

( * ) Notice: Subject to any disclaimer, the term of this patent is extended or adjusted under 35 U.S.C. 154(b) by 475 days.

(21) Appl. No.: 14/379,877

(22) PCT Filed: Mar. 4, 2013

(86) PCT No.: PCT/JP2013/055844
§ 371 (c)(1),
(2) Date: Aug. 20, 2014

(87) PCT Pub. No.: WO2013/133209
PCT Pub. Date: Sep. 12, 2013

(65) Prior Publication Data

US 2016/0214072 A1 Jul. 28, 2016

(30) Foreign Application Priority Data

Mar. 6, 2012 (JP) ..... 2012-049580

(51) Int. Cl.
*B01F 5/06* (2006.01)
*B01F 13/00* (2006.01)
*B01F 3/08* (2006.01)

(52) U.S. Cl.
CPC ..... *B01F 5/0693* (2013.01); *B01F 3/0807* (2013.01); *B01F 5/0685* (2013.01); *B01F 5/0697* (2013.01); *B01F 13/0023* (2013.01)

(58) Field of Classification Search
CPC .... B01F 3/0807; B01F 5/0685; B01F 5/0693; B01F 5/0697; B01F 13/0023
(Continued)

(56) References Cited

U.S. PATENT DOCUMENTS 600,953 A * 3/1898 Rabbi ..... B65D 85/812 206/0.5
2,492,037 A 12/1949 Freeman et al.
(Continued)

FOREIGN PATENT DOCUMENTS

EP 0 167 947 1/1986
GB 2 318 069 4/1998
(Continued)

OTHER PUBLICATIONS

Extended European Search Report issued Nov. 4, 2015 in corresponding European Application No. 13758680.6.
(Continued)

*Primary Examiner* — Abbas Rashid
(74) *Attorney, Agent, or Firm* — Wenderoth, Lind & Ponack, L.L.P.

(57) ABSTRACT

To provide an emulsion preparation device capable of forming an emulsion in a chemical liquid of diverse composition and further realizing a relatively low sliding resistance. An emulsion preparation device (1) provided with a filter part (10), wherein: the filter part (10) is constructed from first and second, two mesh parts (31) and (33) and fibers (32); and the fibers (32) are loaded into a space (30) between the first mesh part (31) and the second mesh part (32).

10 Claims, 8 Drawing Sheets

(58) Field of Classification Search
USPC ..... 222/189.11
See application file for complete search history.

(56) References Cited

U.S. PATENT DOCUMENTS

| | | | | |
|---|---|---|---|---|
| 3,859,999 | A | 1/1975 | Ishikawa | |
| 4,183,681 | A | 1/1980 | Li et al. | |
| 4,820,276 | A * | 4/1989 | Moreno | A61M 5/3145 222/189.06 |
| 4,869,849 | A * | 9/1989 | Hirose | B01F 5/0682 261/78.2 |
| 5,811,227 | A | 9/1998 | Gandasasmita et al. | |
| 6,005,014 | A | 12/1999 | Blackwell et al. | |
| 6,241,220 | B1 | 6/2001 | Blackwell et al. | |
| 7,621,670 | B1 * | 11/2009 | England | B01F 5/0682 138/40 |
| 8,323,490 | B1 * | 12/2012 | Wright | C02F 1/002 210/232 |
| 8,356,927 | B1 * | 1/2013 | Lordi | B01F 5/0685 366/130 |
| 2008/0312315 | A1 * | 12/2008 | Daniloff | A61K 9/0024 514/449 |
| 2010/0121310 | A1 * | 5/2010 | Simonton | B01F 11/0082 604/518 |
| 2010/0274279 | A1 * | 10/2010 | Delmotte | A61B 17/00491 606/213 |
| 2011/0085945 | A1 * | 4/2011 | Mochizuki | B01F 5/0604 422/225 |
| 2013/0313281 | A1 * | 11/2013 | Kane | B65D 83/0033 222/1 |
| 2014/0241960 | A1 * | 8/2014 | Mochizuki | B01F 5/12 422/633 |

FOREIGN PATENT DOCUMENTS

| | | |
|---|---|---|
| JP | 52-35235 | 9/1977 |
| JP | 56-17623 | 2/1981 |
| JP | 9-131519 | 5/1997 |
| JP | 11-509146 | 8/1999 |
| JP | 2003-260343 | 9/2003 |
| JP | 2005-186026 | 7/2005 |
| JP | 2006-346565 | 12/2006 |
| JP | 2009-148761 | 7/2009 |
| WO | 97/02938 | 1/1997 |
| WO | 2007/083763 | 7/2007 |

OTHER PUBLICATIONS

English translation of International Preliminary Report on Patentability (Form PCT/IB/373) together with Written Opinion of the International Searching Authority (Form PCT/ISA/237) issued Sep. 18, 2014 in International (PCT) Application No. PCT/JP2013/055844.

International Search Report (ISR) issued May 28, 2013 in International (PCT) Application No. PCT/JP2013/055844.

* cited by examiner

【FIG1】
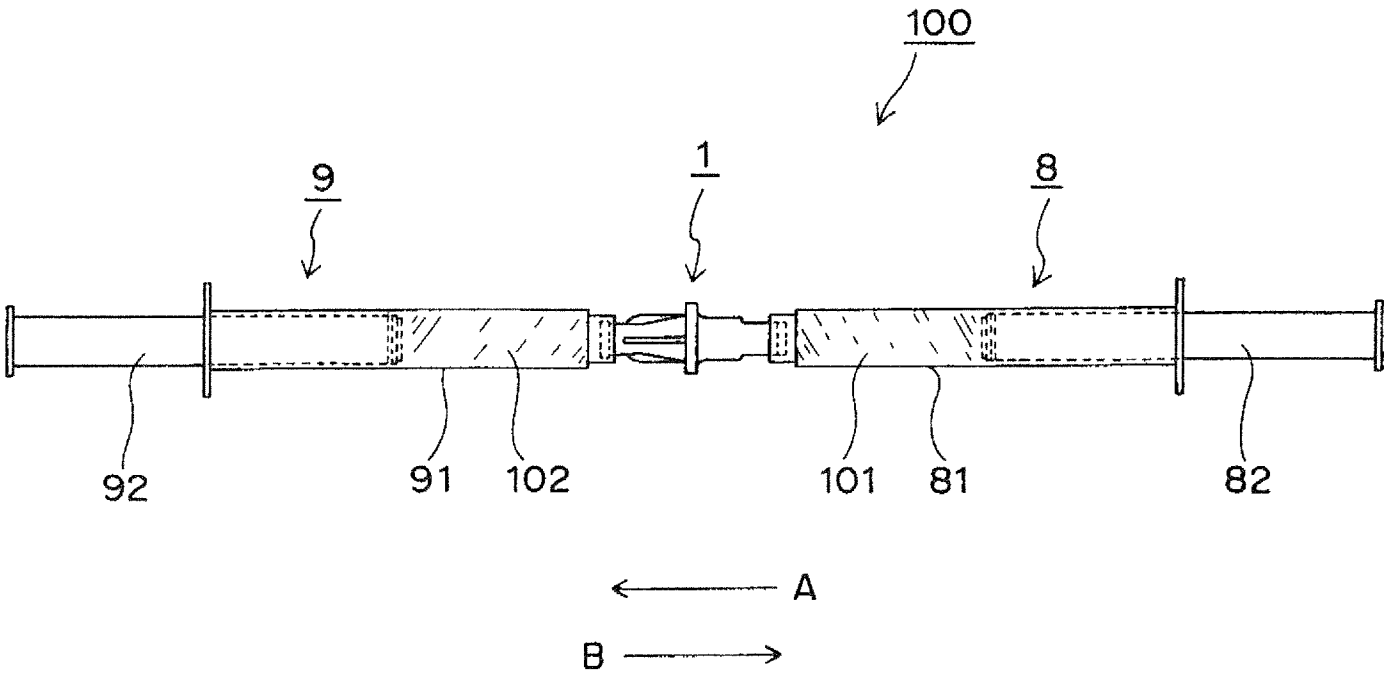

【FIG2】
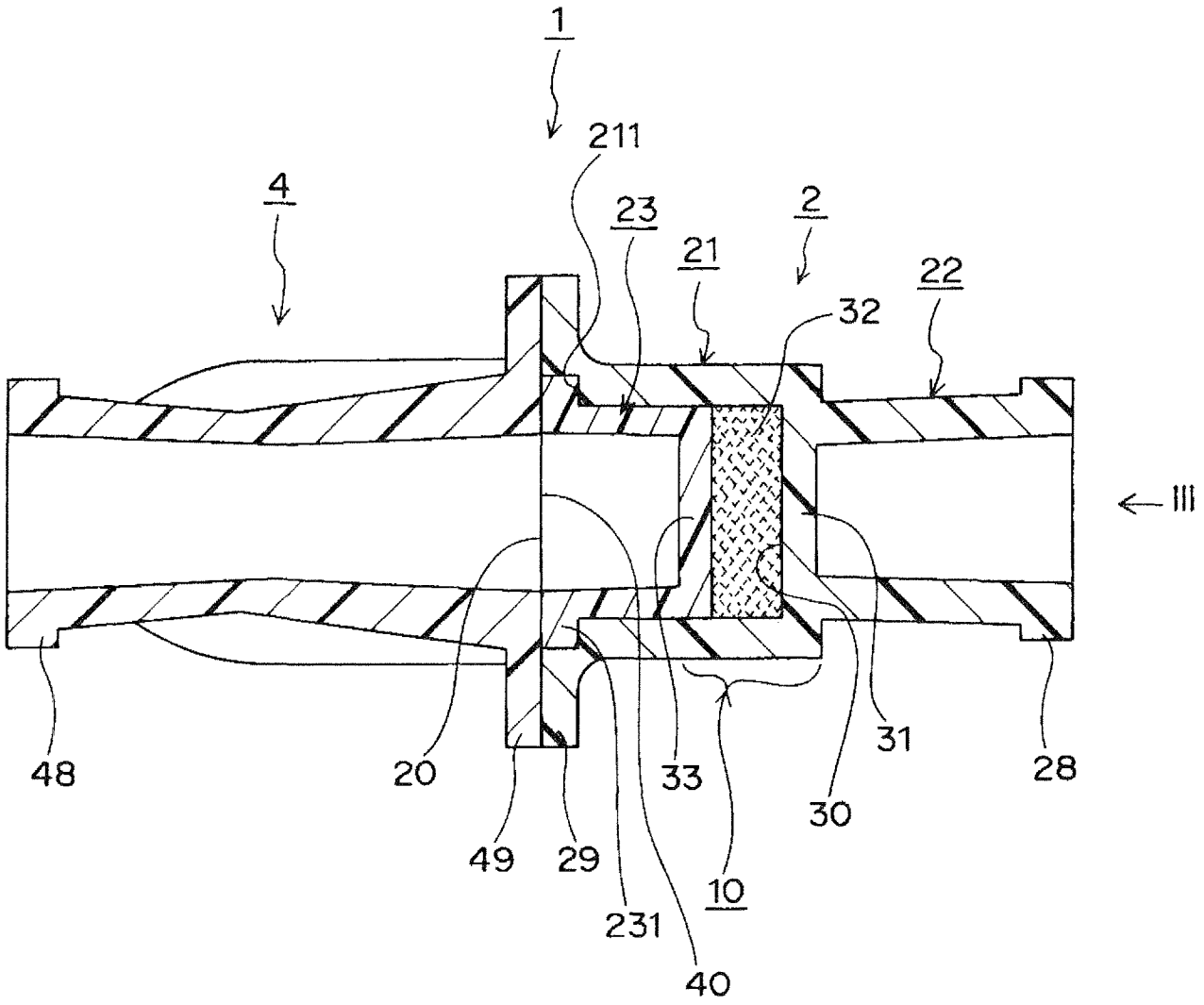

【FIG3】
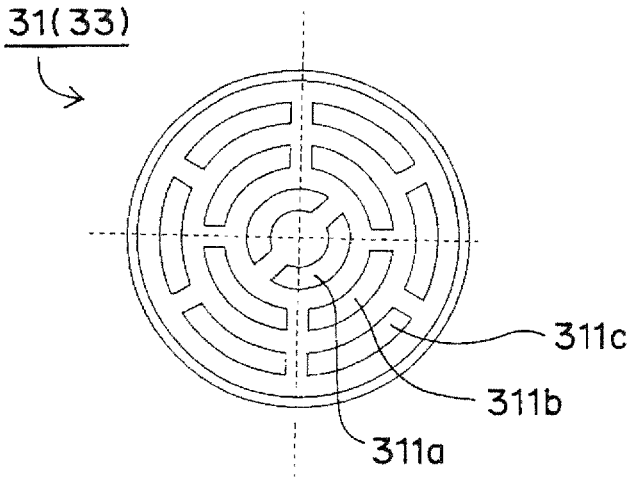

【FIG4】
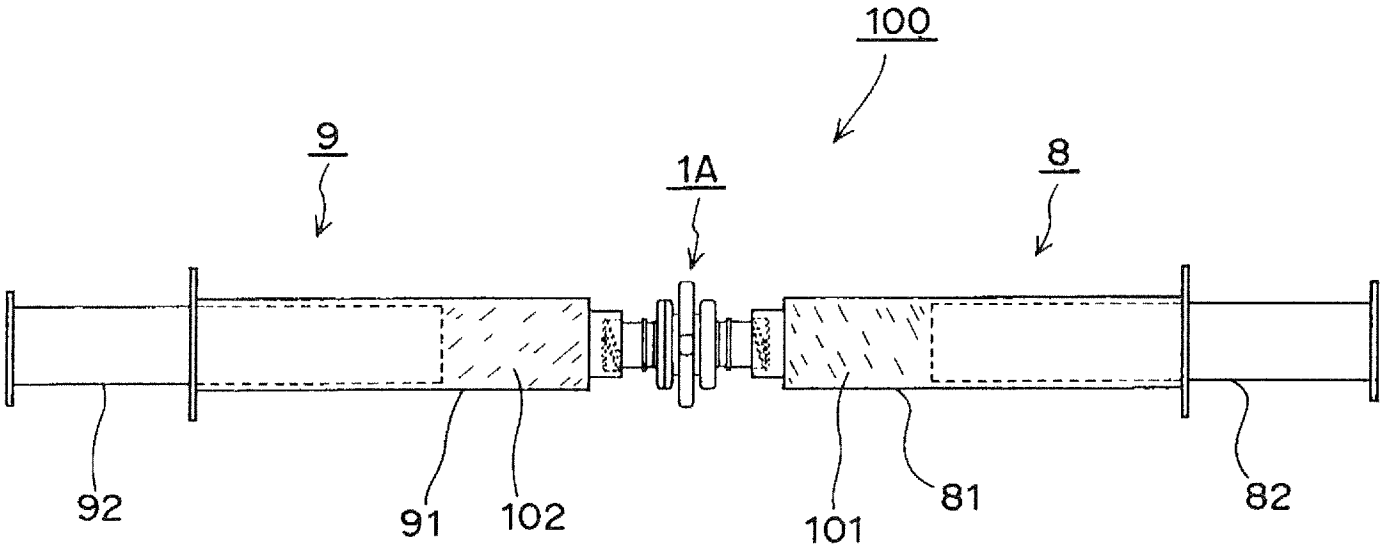

【FIG5】
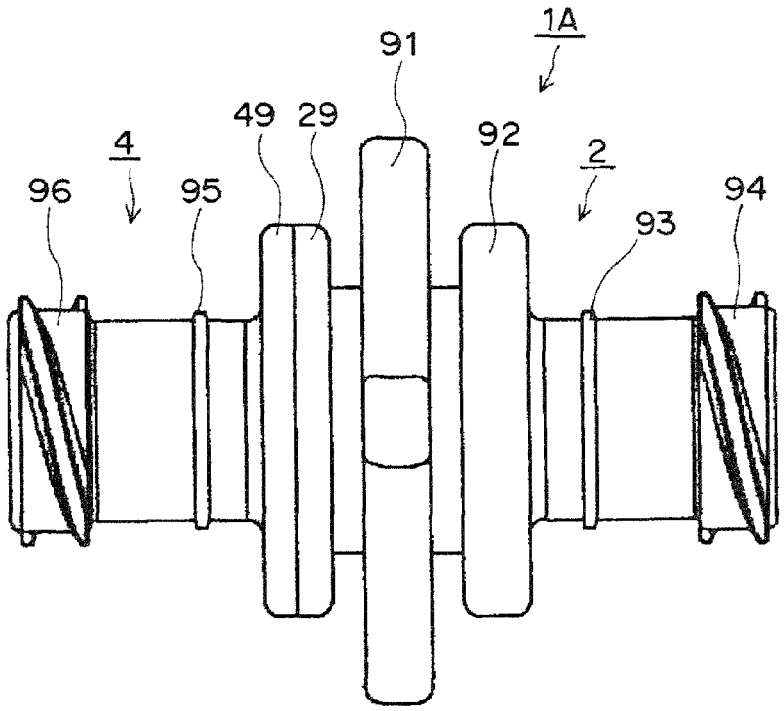
【FIG6】
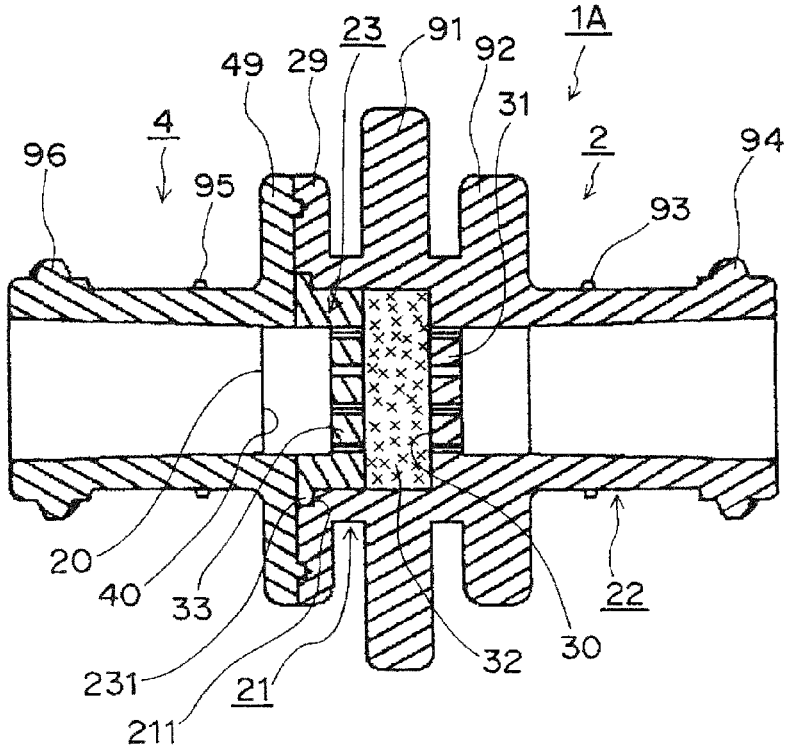

【FIG7】
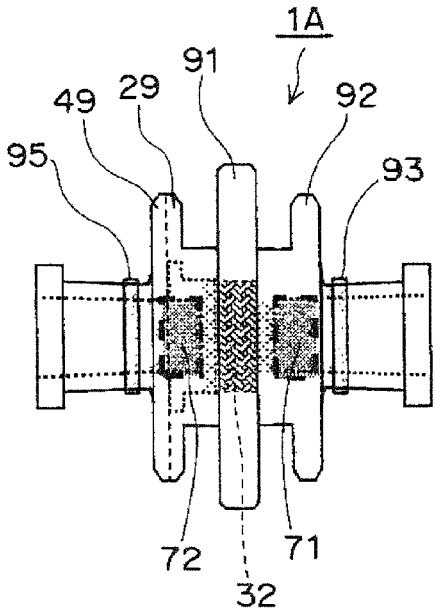
【FIG8】
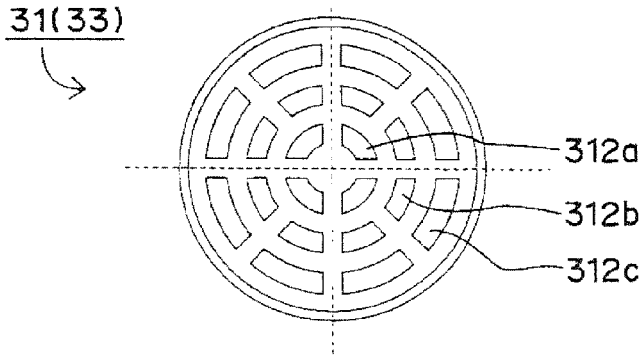
【FIG9】
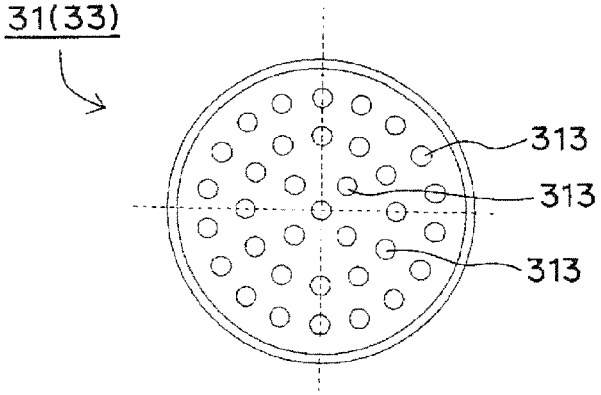

【FIG10】
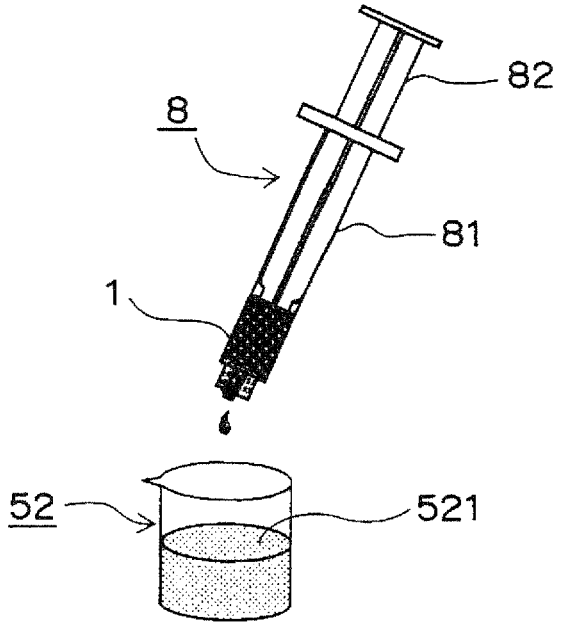
【FIG11】
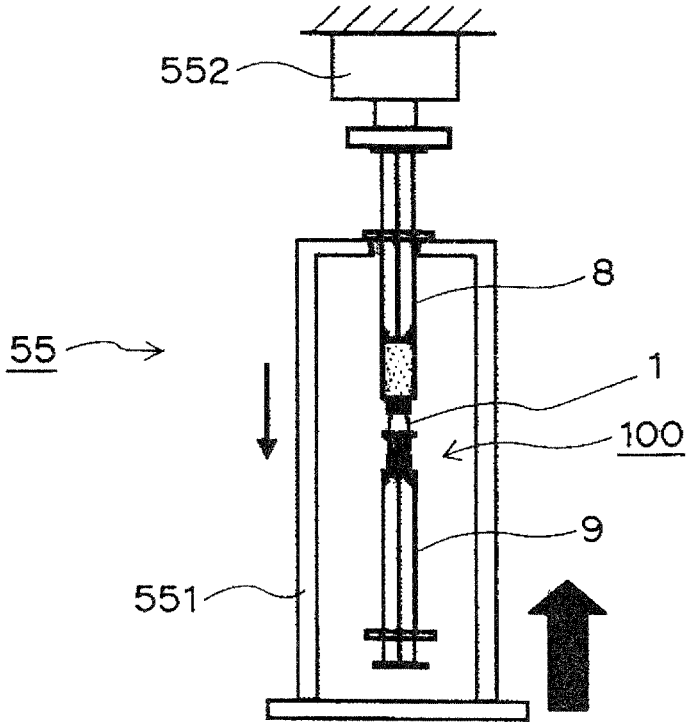

【FIG12】
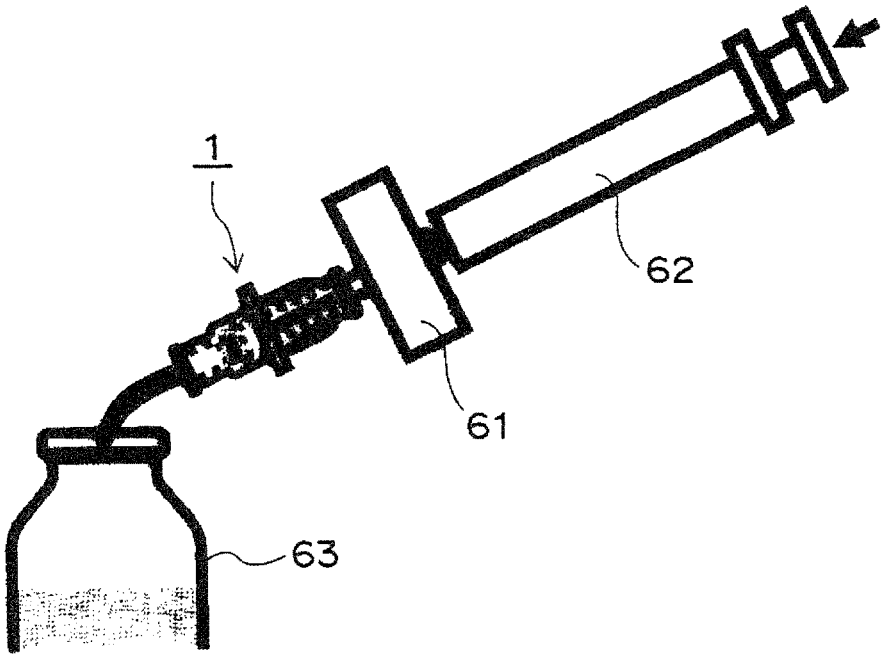

EMULSION PREPARATION DEVICE AND EMULSION PREPARATION METHOD

TECHNICAL FIELD

The present invention relates to a device and a preparation method for mixing a continuous phase and a dispersed phase with each other so as to form an emulsion.

BACKGROUND ART

As emulsion preparation devices in the field of medical equipment, chemical liquid preparation connectors described in Patent Documents 1 and 2 are reported. According to these connectors, a syringe charged with a continuous phase is linked to one side and a syringe charged with a dispersed phase is linked to the other side. Then, when pumping operation is performed alternately on both syringes, both phases are mixed with each other so that an emulsion is formed.

Nevertheless, in the connector of Patent Document 1, according to investigation by the present inventors, it has been recognized that: a large amount of pumping operation is necessary for forming a sufficient emulsion; further, depending on the composition of the chemical liquid, a sufficient emulsion cannot be formed in some cases; and further, an inconvenience of relatively high sliding resistance is present at the time of pumping operation. Further, the connector of Patent Document 1 does not include a filter part. A filter part in the connector of Patent Document 2 employs a porous material fabricated from a glass membrane. None of the connectors of both documents includes a filter part filled with fibers. Patent Document 3 relates to a filter filled with fibers but does not describe an emulsion preparation device. Further, Patent Document 4 also does not describe a connector provided with a filter part filled with fibers.

PRIOR ART REFERENCES

Patent Documents

Patent Document 1: International Publication No. 2007/083763

Patent Document 2: Japanese Unexamined Patent Application Publication No. 2005-186026

Patent Document 3: Japanese Examined Patent Application Publication No. S52-35235

Patent Document 4: Japanese Unexamined Patent Application Publication No. 2006-346565

SUMMARY OF THE INVENTION

Problem to be Solved by the Invention

An object of the present invention is to provide an emulsion preparation device and an emulsion preparation method capable of forming an emulsion in a chemical liquid of diverse composition and further realizing a relatively low sliding resistance.

Means for Solving the Problem

The present invention is characterized by an emulsion preparation device provided with a filter part, wherein: the filter part is constructed from a first and a second mesh part and fibers; and the fibers are loaded into a space between the first mesh part and the second mesh part. That is, the present invention provides the following (1) to (12).

(1) An emulsion preparation device provided with a filter part, wherein:

the filter part is constructed from a first and a second mesh part and fibers;

and the fibers are loaded into a space between the first mesh part and the second mesh part.

(2) The emulsion preparation device according to the above-mentioned (1), wherein:

one side or both sides of the filter part can be connected to a syringe; and an emulsion is formed when a continuous phase and a dispersed phase perform, through the filter part, reciprocating movement between two syringes linked to the both sides of the filter part or alternatively between a syringe linked to one side and a vessel linked to the other side.

(3) The emulsion preparation device according to the above-mentioned (1) or (2), wherein the first mesh part and/or the second mesh part are disks.

(4) The emulsion preparation device according to the above-mentioned (3), wherein the mesh part includes a large number of through holes of arc shape arranged uniformly in a concentric manner and all the through holes have the same area as each other within an error range of 10%.

(5) The emulsion preparation device according to any one of the above-mentioned (1) to (4), wherein the fibers are of a hydrophobic fiber.

(6) The emulsion preparation device according to the above-mentioned (5), wherein the hydrophobic fiber is polyester.

(7) The emulsion preparation device according to any one of the above-mentioned (1) to (4), wherein the fibers are of a hydrophilic fiber.

(8) The emulsion preparation device according to any one of the above-mentioned (1) to (7), wherein the fibers have 50 to 150 deniers and are loaded such that 2.5 to 17.7 mm are present per 1 $mm^3$ of the space.

(9) The emulsion preparation device according to any one of the above-mentioned (1) to (8), wherein the fibers have 50 to 150 deniers and are loaded such that 5.0 to 9.9 mm are present per 1 $mm^3$ of the space.

(10) The emulsion preparation device according to any one of the above-mentioned (1) to (9), constructed from a first cylindrical member and a second cylindrical member, wherein:

the first cylindrical member is constructed from a first cylinder part and a second cylinder part continuous to the first cylinder part;

the second cylinder part has a smaller diameter than the first cylinder part;

in the first cylindrical member, the first mesh part is formed at a boundary between the first cylinder part and the second cylinder part, the fibers are pushed in toward the first mesh part, the second mesh part is pushed against the fibers, and, as a result, the filter part constructed from the first mesh part, the fiber aggregate, and the second mesh part is formed;

the second mesh part is a bottom face of a concave lid fit onto the first cylinder part;

in the concave lid, an outer flange in an aperture periphery abuts against an aperture periphery of the first cylinder part so that the second mesh part is positioned in the inside of the first cylinder part at a predetermined distance to the first mesh part and in parallel thereto; and the first cylindrical member and the second cylindrical member are joined into a single piece by the outer flange in the aperture periphery of the first cylinder part and an outer flange in an aperture periphery of the second cylindrical member.

(11) The emulsion preparation device according to any one of the above-mentioned (1) to (9), constructed from a first cylindrical member and a second cylindrical member, wherein:

the first cylindrical member is constructed from a first cylinder part and a second cylinder part continuous to the first cylinder part;

the second cylinder part has a smaller diameter than the first cylinder part;

in the first cylindrical member, the first mesh part is formed at a boundary between the first cylinder part and the second cylinder part, the fibers are pushed in toward the first mesh part, the second mesh part is pushed against the fibers, and, as a result, the filter part constructed from the first mesh part, the fiber aggregate, and the second mesh part is formed;

the second mesh part is a bottom face of a concave lid fit onto the first cylinder part;

in the concave lid, an outer flange in an aperture periphery abuts against an aperture periphery of the first cylinder part so that the second mesh part is positioned in the inside of the first cylinder part at a predetermined distance to the first mesh part and in parallel thereto;

the first cylindrical member and the second cylindrical member are joined into a single piece by the outer flange in the aperture periphery of the first cylinder part and an outer flange in an aperture periphery of the second cylindrical member;

the fiber aggregate is located in a center of a longitudinal direction; and in a state that the first cylindrical member and the second cylindrical member have been joined into a single piece, an external shape is bilaterally symmetric in the longitudinal direction.

(12) An emulsion preparation method employing the emulsion preparation device according to any one of the above-mentioned (1) to (11).

The emulsion preparation method according to the present invention is characterized by employing the above-mentioned emulsion preparation device according to the present invention.

Effect of the Invention

According to the present invention, in a chemical liquid of diverse composition, an emulsion can be formed and further the sliding resistance can be made relatively low.

BRIEF DESCRIPTION OF THE DRAWINGS

FIG. 1 is an overall side view of a preparation instrument employing an emulsion preparation device of a first embodiment of the present invention.

FIG. 2 is a sectional side view of a device of FIG. 1.

FIG. 3 is a view taken in an arrow III direction in FIG. 1 and showing a first mesh part.

FIG. 4 is an overall side view of a preparation instrument employing an emulsion preparation device of a second embodiment of the present invention.

FIG. 5 is a side view of a device of FIG. 4.

FIG. 6 is a sectional side view of a device of FIG. 4.

FIG. 7 is a transparent side view of a device of FIG. 4.

FIG. 8 is a diagram showing a modification of a first mesh part.

FIG. 9 is a diagram showing another modification of a first mesh part.

FIG. 10 is a diagram showing a drop test in emulsion check tests A and B.

FIG. 11 is a diagram showing a step in a method of sliding resistance evaluation tests A and B.

FIG. 12 is a diagram showing a step in a method of foreign substance evaluation test.

DETAILED DESCRIPTION OF THE INVENTION

First Embodiment

FIG. 1 is an overall side view of a preparation instrument employing an emulsion preparation device of a first embodiment of the present invention. The preparation instrument 100 is constructed from a device 1 and syringes 8 and 9 linked to both sides of the device 1. The syringe 8 is constructed from a cylinder 81 and a plunger 82. The syringe 9 is constructed from a cylinder 91 and a plunger 92.

FIG. 2 is a sectional side view of the device 1. The device 1 is constructed such that the first cylindrical member 2 and the second cylindrical member 4 are joined into a single piece by outer flanges 29 and 49 in the aperture periphery. Here, it is preferable that the device 1 is constructed from a sterilizable material.

The first cylindrical member 2 is constructed from a first cylinder part 21 and a second cylinder part 22 continuous to the first cylinder part 21. The second cylinder part 22 has a smaller diameter than the first cylinder part 21. In the first cylindrical member 2, a first mesh part 31 is formed at the boundary between the first cylinder part 21 and the second cylinder part 22.

Then, in the first cylindrical member 2, fibers 32 are pushed in toward the first mesh part 31 and the second mesh part 33 is pushed against the fibers 32. That is, the fibers 32 are pushed and loaded into a space 30 between the first mesh part 31 and the second mesh part 33. The first mesh part 31, the fibers 32, and the second mesh part 33 constitute a filter part 10. Here, the first mesh part 31 and the second mesh part 33 are disks provided with a large number of through holes. The fibers 32 loaded in the space 30 constitute a fiber aggregate filling the space 30. In the fiber aggregate, a large number of small voids are formed between the fibers. Thus, in the filter part 10, liquid can move back and forth from the first mesh part 31 to the second mesh part 33 and vice versa passing through the voids in the fiber aggregate.

The second mesh part 33 is the bottom face of a concave lid 23 fit onto the first cylinder part 21. In the concave lid 23, the outer flange 231 in the aperture periphery abuts against the aperture periphery 211 of the first cylinder part 21 so that the second mesh part 33 is positioned in the inside of the first cylinder part 21 at a predetermined distance to the first mesh part 31 and in parallel thereto.

A luer taper 48 is formed at the aperture end of the second cylindrical member 4. A luer taper 28 is formed also at the aperture end of the second cylinder part 22 of the first cylindrical member 2. The first cylindrical member 2 and the second cylindrical member 4 are in fluid communication with each other through apertures 20 and 40 of the same size as each other.

FIG. 3 is a view of the first mesh part 31 taken in the arrow III direction. The first mesh part 31 includes a large number of through holes 311 (i.e., through holes 311*a*, 311*b*, and 311*c*) of arc shape arranged uniformly in a concentric manner. All the through holes 311 have the same area as each other within an error range of 10%. The second mesh part 33 also has the same configuration as the first mesh part 31.

The fibers 32 are of a hydrophobic fiber. As the hydrophobic fiber, polyester, polypropylene, polystyrene, Teflon (registered trademark), nylon, polyvinyl chloride, acrylics, or the like may be employed. However, polyester is preferable. It is preferable that the fibers 32 are crimped. The fibers 32 have 50 to 150 deniers and are loaded into the space 30 such that 2.5 to 17.7 mm are present per 1 $mm^2$ of the 2C space 30. Here, it is preferable that loading is performed such that 4.0 to 12.0 mm are present, and it is more preferable that loading is performed such that 5.0 to 9.9 mm are present.

The preparation instrument 100 shown in FIG. 1 is used as follows. That is, an emulsion preparation method employing the device 1 is as follows. Here, in the preparation instrument 100, the syringe 8 is charged with a dispersed phase 101 and the syringe 9 is charged with a continuous phase 102. However, a reversed situation may be employed.

First, the plunger of one syringe is pushed. For example, pumping operation in the direction A is performed on the plunger 82 of the syringe 8. By virtue of this, the dispersed phase 101 moves through the device 1 to the syringe 9 so that the plunger 92 of the syringe 9 is pushed aside in the direction A. At that time, in the syringe 9, the dispersed phase 101 is somewhat mixed with the continuous phase 102.

Next, pumping operation in the direction B is performed on the plunger 92 of the syringe 9. By virtue of this, the dispersed phase 101 and the continuous phase 102 somewhat mixed with each other move through the device 1 to the syringe 8 so that the plunger 82 of the syringe 8 is pushed aside in the direction B. At that time, in the device 1, both phases 101 and 102 somewhat mixed with each other pass through the filter part 10. That is, both phases 101 and 102 somewhat mixed with each other first pass through the second mesh part 33 so as to be dispersed and mixed at that time, then pass through the fibers 32 so as to be further dispersed and mixed at that time, and then pass through the first mesh part 31 so as to be further dispersed and mixed at that time. Thus, both phases 101 and 102 having moved to the syringe 8 are in a state of being mixed more than in the syringe 9.

Next, pumping operation in the direction A is performed on the plunger 82 of the syringe 8. By virtue of this, both phases 101 and 102 mixed more with each other move through the device 1 to the syringe 9 so that the plunger 92 of the syringe 9 is pushed aside in the direction A. At that time, in the device 1, both phases 101 and 102 mixed more with each other pass through the filter part 10. That is, both phases 101 and 102 mixed more with each other first pass through the first mesh part 31 so as to be dispersed and mixed at that time, then pass through the fibers 32 so as to be further dispersed and mixed at that time, and then pass through the second mesh part 33 so as to be further dispersed and mixed at that time. Thus, both phases 101 and 102 having moved to the syringe 9 are in a state of being mixed more than in the syringe 8.

As such, pumping operation on the plunger 82 of the syringe 8 and pumping operation on the plunger 92 of the syringe 9 are repeated alternately. It is preferable that the number of times of the pumping operation is 50 times or smaller. Further, ten times or smaller is more preferable and five times or smaller is the most preferable. By virtue of this, the state of mixing of both phases 101 and 102 progresses further into a state of emulsion which is a target state. Here, the fibers 32 are of a hydrophobic fiber. Thus, the oil phase serves as a continuous phase and the aqueous phase serves as a dispersed phase so that a water-in-oil type emulsion is formed.

According to the device 1 of the configuration, the fibers 32 have 50 to 150 deniers and are loaded into the space 30 such that 2.5 to 17.7 mm are present per 1 $mm^3$ of the space 30. Thus, both phases 101 and 102 can be dispersed and mixed efficiently so that a desired emulsion can be formed.

Further, in the first mesh part 31 and the second mesh part 33, the through holes 311 of the same area as each other are arranged uniformly. Thus, dispersion of both phases 101 and 102 occurs uniformly in the entire region of the mesh part. Thus, also from this point, both phases 101 and 102 can be dispersed and mixed efficiently.

Further, the fibers 32 filling the space 30 have predetermined thickness and length. Further, the first mesh part 31 and the second mesh part 33 include a large number of the through holes 311 of arc shape and hence have a large void ratio. Thus, the sliding resistance at the time of pumping operation can be reduced. This improves the operability.

Second Embodiment

FIG. 4 is an overall side view of a preparation instrument employing an emulsion preparation device of a second embodiment of the present invention. The preparation instrument 100 is constructed from a device 1A and syringes 8 and 9 linked to both sides of the device 1A. The syringe 8 is constructed from a cylinder 81 and a plunger 82. The syringe 9 is constructed from a cylinder 91 and a plunger 92.

FIG. 5 is a side view of the device 1A. FIG. 6 is a sectional side view of the device 1A. The device 1A is different from the device 1 of the first embodiment in the following points.

(i) The aggregate of the fibers 32 filling the space 30 is located in the center of the longitudinal direction.

(ii) The external shape is bilaterally symmetric in the longitudinal direction.

(iii) Liquid surface adjustment ribs 93 and 95 are provided.

That is, the difference is as follows.

The device 1A is constructed such that the first cylindrical member 2 and the second cylindrical member 4 are joined into a single piece by outer flanges 29 and 49 in the aperture periphery. Here, it is preferable that the device 1A is constructed from a sterilizable material.

The first cylindrical member 2 is constructed from a first cylinder part 21 and a second cylinder part 22 continuous to the first cylinder part 21. The second cylinder part 22 has a smaller diameter than the first cylinder part 21. In the first cylindrical member 2, a first mesh part 31 is formed at the boundary between the first cylinder part 21 and the second cylinder part 22.

Then, in the first cylindrical member 2, fibers 32 are pushed in toward the first mesh part. 31 and the second mesh part 33 is pushed against the fibers 32. That is, the fibers 32 are loaded into a space 30 between the first mesh part 31 and the second mesh part 33. The first mesh part 31, the fibers 32, and the second mesh part 33 constitute a filter part 10. Here, the first mesh part 31 and the second mesh part 33 are disks provided with a large number of through holes. The fibers 32 filling the space 30 constitute a fiber aggregate filling the space 30. In the fiber aggregate, a large number of small voids are formed between the fibers. Thus, in the filter part 10, liquid can move back and forth from the first mesh part 31 to the second mesh part 33 and vice versa passing through the voids in the fiber aggregate.

The second mesh part 33 is the bottom face of a concave lid 23 fit onto the first cylinder part 21. In the concave lid 23, the outer flange 231 in the aperture periphery abuts against the aperture periphery 211 of the first cylinder part 21 so that the second mesh part 33 is positioned in the inside of the first cylinder part 21 at a predetermined distance to the first mesh part 31 and in parallel thereto.

The first cylindrical member 2 and the second cylindrical member 4 are in fluid communication with each other through apertures 20 and 40 of the same size as each other.

Then, the aggregate of the fibers 32 filling the space 30 is located in the center of the longitudinal direction. That is, the space 30 is located in the center of the longitudinal direction.

Further, as seen From FIG. 5, the external shape of the device 1A is bilaterally symmetric in the longitudinal direction. That is, the first cylindrical member 2 includes an outer flange 29 in the aperture periphery, a large flange 91, a small flange 92, a liquid surface adjustment rib 93, and a connection end part 94. On the other hand, the second cylindrical member 4 includes an outer flange 49 in the aperture periphery, a liquid surface adjustment rib 95, and a connection end part 96. Then, when the first cylindrical member 2 and the second cylindrical member 4 abut against each other at the outer flange 29 and the outer flange 49 so as to be joined together, in the device 1A, the large flange 91 is located in the center of the longitudinal direction. Further, on both sides thereof, the small flange 92 and the outer flanges 29 and 49 joined into a single piece are located similarly. Furthermore, on both sides thereof, the liquid surface adjustment rib 93 and the liquid surface adjustment rib 95 are located similarly. Further, on both sides thereof, the connection end part 94 and the connection end part 96 are located similarly. As a result, the device 1A is bilaterally symmetric in the longitudinal direction.

The first mesh part 31, the fibers 32, and the second mesh part 33 are the same as those in the first embodiment.

When the preparation instrument 100 shown in FIG. 4 is used similarly to the first embodiment, an emulsion can be formed similarly to the first embodiment.

Further, in the device 1A, as shown in FIG. 7, parts where the formed emulsion remains are spaces 71 and 72, whose volumes are small. Thus, according to the device 1A, the generation efficiency for an emulsion can be improved.

Further, in the device 1A, the liquid surface adjustment ribs 93 and 95 indicate the upper limits for the height positions of the continuous phase and the dispersed phase at the time of air vent, and serve as guides used when the plungers 82 and 92 are pushed for air vent. Thus, according to the device 1A, the workability of air vent can be improved.

[Modified Structures]

The following modified structures may be adopted.

(1) The fibers 32 may be of a hydrophilic fiber. For example, cotton, rayon, vinylon, or the like may be employed. In this case, the aqueous phase serves as a continuous phase and the oil phase serves as a dispersed phase so that an oil-in-water type emulsion is formed.

(2) The first mesh part 31 and the second mesh part 33 may be disks as shown in FIG. 8 or 9. The mesh part in FIG. 8 includes a large number of through holes 312 (i.e., through holes 312*a*, 312*b*, and 312*c*) of arc shape aligned in a concentric manner. Then, the area of each through hole 312 becomes larger as being located in the outer side. The mesh part in FIG. 9 includes a large number of circular holes 313 distributed uniformity. Then, all the circular holes 313 have the same area as each other.

(3) The first mesh part 31 and the second mesh part 33 may have a shape other than the disk and, for example, may have the shape of a block.

(4) A mixed solution of a dispersed phase and a continuous phase may be loaded in any one of the syringe 8 and the syringe 9. In this case, no liquid is loaded in the other one.

EXAMPLES

The device 1 of examples 1 to 14 and the device 1A of example 15 were prepared. Then, emulsion check test A and sliding resistance evaluation test A were performed on the device 1 of examples 1 to 11. Further, emulsion check test B and sliding resistance evaluation test B were performed on the device 1 of examples 12, 13, and 14. Emulsion check test B was performed on the device 1A of example 15. Sliding resistance evaluation test C and foreign substance evaluation test were performed on the device 1 of example 12 and the device 1A of example 15.

Example 1

The device 1 having the configuration of FIG. 2. Detailed dimensions and the like are as follows. Here, the fibers 32 are crimped and loaded into the space 30.

Space 30:
- 56.52 $mm^3$

Fibers 32:
- Polyester
- 50 deniers
- 1000 mm (17.7 mm is present per 1 $mm^3$ of space 30)

First mesh part 31 and second mesh part 33:
- Configuration of FIG. 3
  - Through hole 311*a:* 0.43 $mm^2$
  - Through hole 311*b:* 0.45 $mm^2$
  - Through hole 311*c:* 0.46 $mm^2$
  - Opening area: 5.42 $mm^2$

Example 2

The following point alone is different from example 1.

Fibers 32:
- 560 mm (9.9 mm is present per 1 $mm^3$ of space 30)

Example 3

The following point alone is different from example 1.

Fibers 32:
- 280 mm (5.0 mm is present per 1 $mm^3$ of space 30)

Example 4

The following point alone is different from example 1.

Fibers 32:
- 140 mm (2.5 mm is present per 1 mm of space 30)

Example 5

The following point alone is different from example 1.

Fibers 32:
- 100 deniers

Example 6

The following points alone are different from example 1.
Fibers 32:
100 deniers
560 mm (9.9 mm is present per 1 mm of space 30)

Example 7

The following points alone are different from example 1.
Fibers 32:
100 deniers
280 mm (5.0 mm is present per 1 $mm^3$ of space 30)

Example 8

The following points alone are different from example 1.
Fibers 32:
100 deniers
140 mm (2.5 mm is present per 1 $mm^3$ of space 30)

Example 9

The following points alone are different from example 1.
Fibers 32:
150 deniers
560 mm (9.9 mm is present per 1 $mm^3$ of space 30)

Example 10

The following points alone are different from example 1.
Fibers 32:
150 deniers
280 mm (5.0 mm is present per 1 mm of space 30)

Example 11

The following points alone are different from example 1.
Fibers 32:
150 deniers
140 mm (2.5 mm is present per 1 mm of space 30)

Example 12

The following points alone are different from example 1.
Fibers 32:
75 deniers
280 mm (5.0 mm is present per 1 $mm^3$ of space 30)

Example 13

The following points alone are different from example 12.
First mesh part 31 and second mesh part 33:
Configuration of FIG. 8
Through hole 312*a:* 0.17 $mm^2$
Through hole 312*b:* 0.18 $mm^2$
Through hole 312*c:* 0.35 $mm^2$
Opening area: 4.92 $mm^2$ Example 14

The following points alone are different from example 12.
First mesh part 31 and second mesh part 33:
Configuration of FIG. 9
Through hole 313: 0.07 $mm^2$
Opening area: 2.45 $mm^2$ Example 15

The device 1A having the configuration of FIG. 6. Detailed dimensions and the like are as follows. Here, the fibers 32 are crimped and loaded into the space 30.
Space 30:
56.52 $mm^3$
Fibers 32:
Polyester
75 deniers
280 mm (5.0 mm is present per 1 $mm^3$ of space 30)
First mesh part 31 and second mesh part 33:
Configuration of FIG. 3
Through hole 311*a:* 0.43 $mm^2$
Through hole 311*b:* 0.45 $mm^2$
Through hole 311*c:* 0.46 $mm^2$
Opening area: 5.42 $mm^2$
(Emulsion Check Test A)
[Test Method]
As shown in FIGS. 1 and 10, the following procedure was employed.
(1) The preparation instrument 100 of FIG. 1 was prepared. Then, 1.5 ml of 2% L-arginine aqueous solution serving as a dispersed phase, that is, an aqueous phase, was loaded into the space 8. Then, 1.5 ml of Montanide (official name: Montanide ISA 51VG) serving as a continuous phase, that is, an oil phase, was loaded into the syringe 9. Here, the syringes 8 and 9 were B BRAUN-fabricated and had a capacity of 5 ml.
(2) Pumping operation was manually performed alternately on the plunger 82 of the syringe 8 and the plunger 92 of the syringe 9. This operation was repeated 5 times. As a result, both phases were accommodated into the syringe 8.
(3) The syringe 9 was removed. Then, as shown in FIG. 10, a mixed solution of physiological saline solution and Montanide in the cylinder 8 was dripped through the device 1 to the surface 521 of the water in the vessel 52. That so-called "drop test" was performed.
[Results]
Table 1 shows test results. Each test was performed three times.

TABLE 1

| | Fibers | | Emulsion check test A | | |
|---|---|---|---|---|---|
| | Thickness | Length | | | |
| Ex. | (denier) | (mm) | First | Second | Third |
| 1 | 50 | 1000 | ○ | ○ | ○ |
| 2 | 50 | 560 | ○ | ○ | ○ |
| 3 | 50 | 280 | ○ | ○ | ○ |
| 4 | 50 | 140 | x | ○ | x |
| 5 | 100 | 1000 | ○ | ○ | ○ |
| 6 | 100 | 560 | ○ | ○ | ○ |
| 7 | 100 | 280 | ○ | ○ | ○ |
| 8 | 100 | 140 | ○ | ○ | x |
| 9 | 150 | 560 | ○ | ○ | ○ |
| 10 | 150 | 280 | ○ | ○ | ○ |
| 11 | 150 | 140 | x | ○ | x |

When dripped liquid does not diffuse over the surface 521, an emulsion has been formed satisfactorily. This situation is indicated by "○" in the test result. When dripped liquid diffuses over the surface 521, an emulsion has not been formed. This situation is indicated by "x" in the test result.

As seen from Table 1, in examples 1 to 11, a desired emulsion has been formed. In particular, in examples 1, 2, 3, 5, 6, 7, 9, and 10, a satisfactory emulsion has been formed.

(Emulsion Check Test B)

[Test Method]

As shown in FIGS. 1 and 10, the following procedure was employed.

(1) The preparation instrument 100 of FIG. 1 was prepared in examples 12 to 14 and the preparation instrument 100 of FIG. 4 was prepared in example 15. Then, 1.5 ml of 2% L-arginine aqueous solution serving as a dispersed phase, that is, an aqueous phase, was loaded into the space 8. Then, 1.5 ml of Montanide serving as a continuous phase, that is, an oil phase, was loaded into the space 9. Here, the syringes 8 and 9 were B BRAUN-fabricated and had a capacity of 5 ml.

(2) Pumping operation of alternately pushing on the plunger 82 of the syringe 8 and the plunger 92 of the syringe 9 was performed manually. This operation was repeated 5 times. As a result, both phases were accommodated into the syringe 8.

(3) The syringe 9 was removed. Then, as shown in FIG. 10, a mixed solution of L-arginine aqueous solution and Montanide in the cylinder 8 was dripped through the device 1 to the surface 521 of the water in the vessel 52. That is, a so-called "drop test" was performed. Further, at that time, the presence or absence of falling out of the fibers 32 in the device 1 was also investigated.

[Results]

Table 2 shows test results. Each test was performed twice.

TABLE 2

| Ex. | Mesh part | Emulsion check test B First | Emulsion check test B Second | Fiber falling out |
|---|---|---|---|---|
| 12 | FIG. 3 | ○ | ○ | None |
| 13 | FIG. 8 | ○ | ○ | None |
| 14 | FIG. 9 | ○ | ○ | None |
| 15 | FIG. 3 | ○ | ○ | None |

The meanings of "○" and "x" in the test results are the same as in emulsion check test A.

As seen from Table 2, even when the first mesh part 31 and the second mesh part 33 had whichever configuration of FIGS. 3, 8, and 9, a satisfactory emulsion has been formed.

(Sliding Resistance Evaluation Test A)

[Test Method]

As shown in FIG. 11, the following procedure was employed.

(1) The preparation instrument 100 of FIG. 1 was prepared. Then, 1.5 ml of 2% L-arginine aqueous solution serving as a dispersed phase, that is, an aqueous phase, was loaded into the space 8. Then, 1.5 ml of Montanide serving as a continuous phase, that is, an oil phase, was loaded into the space 9. Here, the syringes 8 and 9 were B BRAUN-fabricated and had a capacity of 5 ml.

(2) Pumping operation was manually performed alternately on the plunger 82 of the syringe 8 and the plunger 92 of the syringe 9. This operation was repeated 5 times. As a result, both phases were accommodated into the syringe 8.

(3) As shown in FIG. 11, the preparation instrument 100 was installed in an autograph device 55 (model EZ-L-500N, Shimadzu Corporation) provided with a support base 551 and a load cell 552. Then, the sliding resistance at the time of alternately pushing the plunger 82 of the syringe 8 and the plunger 92 of the syringe 9 was measured with the load cell 552. Further, as the resistance, a mean value was calculated for the load during the plunger stroke from 5 to 15 mm.

Here, the sliding speed of the plungers 82 and 92 of both syringes 8 and 9 was set at 500 mm/min and 1000 mm/min.

[Results]

Table 3 shows test results. Each test was performed once for the sliding speed of the plunger 82 of 500 mm/min and performed twice for 1000 mm/min.

TABLE 3

| Ex. | Fibers Thickness (denier) | Fibers Length (mm) | Sliding speed 500 mm/min Sliding resistance evaluation test A | Sliding speed 1000 mm/min Sliding resistance evaluation test A First | Sliding speed 1000 mm/min Sliding resistance evaluation test A Second |
|---|---|---|---|---|---|
| 1 | 50 | 1000 | ○ | ○ | x |
| 2 | 50 | 560 | ○ | ○ | ○ |
| 3 | 50 | 280 | ○ | ○ | ○ |
| 4 | 50 | 140 | ○ | ○ | ○ |
| 5 | 100 | 1000 | x | ○ | x |
| 6 | 100 | 560 | ○ | ○ | ○ |
| 7 | 100 | 280 | ○ | ○ | ○ |
| 8 | 100 | 140 | ○ | ○ | ○ |
| 9 | 150 | 560 | ○ | ○ | ○ |
| 10 | 150 | 280 | ○ | ○ | ○ |
| 11 | 150 | 140 | ○ | ○ | ○ |

In a case that the pumping operation speed is 500 mm/min, the operability is light and satisfactory when the sliding resistance is lower than 70 N. Thus, this situation is indicated by "○". Further, in case of 70 N or higher, this situation is indicated by "x". Further, in a case that the pumping operation speed is 1000 mm/min, the operability is light and satisfactory when the sliding resistance is lower than 140 N. Thus, this situation is indicated by "○". Further, in case of 140 N or higher, this situation is indicated by "x".

As seen from Table 3, in examples 1 to 11, the operability of pumping was satisfactory.

(Sliding Resistance Evaluation Test B)

[Test Method]

As shown in FIG. 11, the following procedure was employed.

(1) The preparation instrument 100 of FIG. 1 was prepared. Then, 1.5 ml of 2% L-arginine aqueous solution serving as a dispersed phase, that is, an aqueous phase, was loaded into the space 8. Then, 1.5 ml of Montanide serving as a continuous phase, that is, an oil phase, was loaded into the space 9. Here, the syringes 8 and 9 were B BRAUN-fabricated and had a capacity of 5 ml.

(2) Pumping operation was manually performed alternately on the plunger 82 of the syringe 8 and the plunger 92 of the syringe 9. This operation was repeated 5 times. As a result, both phases were accommodated into the syringe 8.

(3) As shown in FIG. 11, the preparation instrument 100 was installed in an autograph device 55 (model AG-500BR, Shimadzu Corporation) provided with a support base 551 and a load cell 552. Then, the sliding resistance at the time of alternately pushing the plunger 82 of the syringe 8 and the plunger 92 of the syringe 9 was measured with the load cell 552. The resistance was measured at the first time, the second time, and the third time of pumping operation. Further, as the resistance, a mean value was calculated for the load during the plunger stroke from 5 to 15 mm. The sliding speed was set at 500 mm/min.

[Results]

TABLE 4

| | | Sliding resistance (N) | | | | | | | |
|---|---|---|---|---|---|---|---|---|---|
| | Mesh | First pumping | | Second pumping | | Third pumping | | | Standard |
| Ex. | part | Syr. 8 | Syr. 9 | Syr. 8 | Syr. 9 | Syr. 8 | Syr. 9 | Average | Deviation |
| 12 | FIG. 3 | 20.23 | 19.51 | 18.50 | 20.07 | 20.79 | 21.17 | 20.05 | 0.95 |
| 13 | FIG. 8 | 21.71 | 23.01 | 23.89 | 25.75 | | | 23.59 | 1.70 |
| 14 | FIG. 9 | 33.08 | 30.39 | 26.91 | 27.37 | | | 29.44 | 2.88 |

As seen from Table 4, in examples 12, 13, and 14, the sliding resistance was lower than the conventional art. Thus, the operability was satisfactory. In particular, in example 12, that is, in a case that the mesh part having the configuration of FIG. 3 was employed, the sliding resistance was the lowest. Thus, in a case that the mesh part having the configuration of FIG. 3 was employed, the operability was the most satisfactory.

(Sliding Resistance Evaluation Test C)

[Test Method]

As shown in FIG. 11, the following procedure was employed.

(1) The preparation instrument 100 of FIG. 1 was prepared in example 12 and the preparation instrument 100 of FIG. 4 was prepared in example 15. Then, 1.5 ml of physiological saline serving as a dispersed phase, that is, an aqueous phase, was loaded into the syringe 8. Then, 1.5 ml of Montanide serving as a continuous phase, that is, an oil phase, was loaded into the space 9. Here, the syringes 8 and 9 were B BRAUN-fabricated and had a capacity of 5 ml.

(2) Pumping operation was manually performed alternately on the plunger 82 of the syringe 8 and the plunger 92 of the syringe 9. This operation was repeated 5 times. As a result, both phases were accommodated into the syringe 8.

(3) As shown in FIG. 11, the preparation instrument 100 was installed in an autograph device 55 (model AG-Xplus, Shimadzu Corporation) provided with a support base 551 and a load cell 552. Then, the sliding resistance at the time of alternately pushing the plunger 82 of the syringe 8 and the plunger 92 of the syringe 9 was measured with the load cell 552. The resistance was measured at the first time, the second time, and the third time of pumping operation. Further, as the resistance, a mean value was calculated for the load during the plunger stroke from 5 to 15 mm. The sliding speed was set at 500 mm/min.

[Results]

Table 5 shows test results.

TABLE 5

| | | Sliding resistance (N) | | | | | | | |
|---|---|---|---|---|---|---|---|---|---|
| | Mesh | First pumping | | Second pumping | | Third pumping | | | Standard |
| Ex. | part | Syr. 8 | Syr. 9 | Syr. 8 | Syr. 9 | Syr. 8 | Syr. 9 | Average | Deviation |
| 12 | FIG. 3 | 23.32 | 22.57 | 21.25 | 34.50 | 21.20 | 21.63 | 24.08 | 4.72 |
| 15 | FIG. 3 | 22.69 | 27.98 | 25.38 | 25.70 | 22.48 | 22.93 | 24.53 | 2.01 |

As seen from Table 5, in examples 12 and 15, the sliding resistance was lower than the conventional art. Thus, the operability was satisfactory.

(Foreign Substance Evaluation Test)

[Test Method]

(1) FIG. 12 shows the situation of the test concerning the device 1 of example 12. Here, in example 15, the device 1A was employed in place of the device 1. A glass syringe 62 was attached through a 0.8-μm membrane filter 61 to one end of the device 1. Then, 10 ml of particulate-free deionized water was vigorously ejected through the filter 61 and the device 1 into a clean glass bottle 63. This operation was performed five times in total. Then, the filter 61 and the syringe 62 were removed and then attached to the other end of the device 1 similarly, and then the same operation was performed. By virtue of this, approximately 100 ml of deionized water was collected in the glass bottle 63. This deionized water was employed as the sample.

(2) Japanese Pharmacopoeia Sixteenth Edition "Insoluble Particulate Matter Test for Injections, Method 1. Light Obscuration Particle Count Test" was performed on the sample. Specifically, insoluble particulates per 10 ml of the sample were measured four times with an in-liquid particulate measurement instrument (product name: RION KL-04). Then, the second to the fourth measurement values were converted into the number of particulates per vessel. This measurement was performed five times in total with changing the sample.

[Results]

Table 6 shows the results of example 12. Table 7 shows the results of example 15.

TABLE 6

| Partic. Size (μm) | First | Second | Third | Fourth | Fifth | Average |
|---|---|---|---|---|---|---|
| 1.3≤ | 88 | 137 | 73 | 64 | 71 | 87 |
| 2≤ | 45 | 74 | 37 | 35 | 36 | 45 |
| 5≤ | 24 | 27 | 16 | 14 | 12 | 19 |
| 10≤ | 15 | 14 | 11 | 4 | 5 | 10 |
| 15≤ | 5 | 4 | 4 | 1 | 2 | 3 |

TABLE 6-continued

| Partic. Size (μm) | First | Second | Third | Fourth | Fifth | Average |
|---|---|---|---|---|---|---|
| 25≤ | 0 | 0 | 0 | 0 | 0 | 0 |
| 50≤ | 0 | 0 | 0 | 0 | 0 | 0 |
| 100≤ | 0 | 0 | 0 | 0 | 0 | 0 |

TABLE 7

| Partic. Size (μm) | First | Second | Third | Fourth | Fifth | Average |
|---|---|---|---|---|---|---|
| 1.3≤ | 980 | 108 | 155 | 210 | 108 | 136 |
| 2≤ | 500 | 47 | 85 | 74 | 65 | 64 |
| 5≤ | 200 | 15 | 39 | 23 | 21 | 24 |
| 10≤ | 80 | 8 | 18 | 6 | 2 | 8 |
| 15≤ | 30 | 4 | 3 | 1 | 0 | 2 |
| 25≤ | 0 | 0 | 0 | 0 | 0 | 0 |
| 50≤ | 0 | 0 | 0 | 0 | 0 | 0 |
| 100≤ | 0 | 0 | 0 | 0 | 0 | 0 |

With reference to a test method "B. Solutions for injection supplied in containers with a nominal content of less than 100 ml" in the above-mentioned Japanese Pharmacopoeia, the allowance criterion for the average number of particulates is "6000 or fewer for particulates of 10 μm or larger and 600 or fewer for particulates of 25 μm or larger, per vessel". However, in the present test, a ten-fold severer allowance criterion was employed that "600 or fewer for particulates of 10 μm or larger and 60 or fewer for particulates of 25 μm or larger, per vessel".

In both of examples 12 and 15, the severer allowance criterion has been satisfied. Thus, both devices 1 and 1A are excellent in the foreign substance quality and hence have sufficient cleanliness for the use as medical equipment.

INDUSTRIAL APPLICABILITY

The emulsion preparation device of the present invention can form an emulsion for a chemical liquid of diverse composition, further can realize a relatively low sliding resistance, and hence has a great advantage in industrial utilization.

DESCRIPTION OF REFERENCE NUMERALS

1: 1A Device, 10: Filter part, 100: Preparation instrument, 2: First cylindrical member, 21: First cylinder part, 211: Aperture periphery, 22: Second cylinder cart, 23: Concave lid, 231: Outer flange, 28: Luer taper, 31: First mesh part, 311: Through hole, 32: Fibers, 33: Second mesh part, 4: Second cylindrical member, 29, 49: Outer flange, 8, 9: Syringe

The invention claimed is:

1. An emulsion preparation device comprising:

a filter part, the filter part including:

a first mesh part;

a second mesh part; and fibers, the fibers being located in a space between the first mesh part and the second mesh part so as to constitute a fiber aggregate;

wherein at least one of the first mesh part and the second mesh part is a disk; and wherein the disk of the at least one of the first mesh part and the second mesh part includes a plurality of through holes each having an arc shape, all of the through holes in the disk being uniformly arranged in a concentric manner and having the same area within an error range of 10%.

2. The emulsion preparation device according to claim 1, wherein:

one side or both sides of the filter part is configured to be connected to a syringe; and the filter part is configured such that an emulsion is formed when a continuous phase and a dispersed phase perform, through the filter part, reciprocating movement (i) between two syringes linked to the both sides of the filter part; or (ii) between a syringe linked to one side and a vessel linked to the other side.

3. The emulsion preparation device according to claim 1, wherein the fibers are hydrophobic.

4. The emulsion preparation device according to claim 3, wherein the hydrophobic fibers are polyester.

5. The emulsion preparation device according to claim 1, wherein the fibers are hydrophilic.

6. The emulsion preparation device according to claim 1, wherein the fibers have 50 deniers to 150 deniers and are loaded such that 2.5 mm to 17.7 mm are present per 1 $mm^3$ of the space.

7. The emulsion preparation device according to claim 1, wherein the fibers have 50 deniers to 150 deniers and are loaded such that 5.0 mm to 9.9 mm are present per 1 $mm^3$ of the space.

8. The emulsion preparation device according to claim 1, further comprising:

a first cylindrical member and a second cylindrical member;

wherein the first cylindrical member comprises a first cylinder part and a second cylinder part continuous to the first cylinder part;

wherein the second cylinder part has a smaller diameter than the first cylinder part;

wherein, in the first cylindrical member, the first mesh part is formed at a boundary between the first cylinder part and the second cylinder part, the fibers being pushed toward the first mesh part, the second mesh part being pushed against the fibers so as to form the filter part from the first mesh part, a fiber aggregate formed of the fibers, and the second mesh part;

wherein the second mesh part is a bottom face of a concave lid fit onto the first cylinder part;

wherein, in the concave lid, an outer flange in an aperture periphery abuts against an aperture periphery of the first cylinder part so that the second mesh part is positioned in the inside of the first cylinder part at a predetermined distance to the first mesh part and in parallel thereto; and wherein the first cylindrical member and the second cylindrical member are joined into a single piece by the outer flange in the aperture periphery of the first cylinder part and an outer flange in an aperture periphery of the second cylindrical member.

9. The emulsion preparation device according to claim 1, further comprising:

a first cylindrical member and a second cylindrical member;

wherein the first cylindrical member comprises a first cylinder part and a second cylinder part continuous to the first cylinder part;

wherein the second cylinder part has a smaller diameter than the first cylinder part;

wherein, in the first cylindrical member, the first mesh part is formed at a boundary between the first cylinder part and the second cylinder part, the fibers being pushed toward the first mesh part, the second mesh part being pushed against the fibers so as to form the filter part from the first mesh part, a fiber aggregate of the fibers, and the second mesh part;

wherein the second mesh part is a bottom face of a concave lid fit onto the first cylinder part;

wherein, in the concave lid, an outer flange in an aperture periphery abuts against an aperture periphery of the first cylinder part so that the second mesh part is positioned in the inside of the first cylinder part at a predetermined distance to the first mesh part and in parallel thereto;

wherein the first cylindrical member and the second cylindrical member are joined into a single piece by the outer flange in the aperture periphery of the first cylinder part and an outer flange in an aperture periphery of the second cylindrical member;

wherein the fiber aggregate is located in a center of a longitudinal direction of the emulsion preparation device; and wherein, in a state that the first cylindrical member and the second cylindrical member have been joined into a single piece, an external shape is bilaterally symmetric in the longitudinal direction.

10. An emulsion preparation method employing the emulsion preparation device according to claim 1.

* * * * *